US009374868B2

(12) United States Patent
Van Endert et al.

(10) Patent No.: US 9,374,868 B2
(45) Date of Patent: Jun. 21, 2016

(54) LIGHTING DEVICE

(75) Inventors: Tony Petrus Van Endert, Lommel (BE); Markus Wilhelmus Maria Coopmans, Helden (NL)

(73) Assignee: KONINKLIJKE PHILIPS N.V., Eindhoven (NL)

( * ) Notice: Subject to any disclaimer, the term of this patent is extended or adjusted under 35 U.S.C. 154(b) by 164 days.

(21) Appl. No.: 13/996,878

(22) PCT Filed: Dec. 13, 2011

(86) PCT No.: PCT/IB2011/055627
§ 371 (c)(1),
(2), (4) Date: Jun. 21, 2013

(87) PCT Pub. No.: WO2012/085754
PCT Pub. Date: Jun. 28, 2012

(65) Prior Publication Data

US 2013/0264967 A1 Oct. 10, 2013

(30) Foreign Application Priority Data

Dec. 22, 2010 (EP) ..... 10196376

(51) Int. Cl.
*G05F 1/00* (2006.01)
*H05B 37/02* (2006.01)

(52) U.S. Cl.
CPC ..... *H05B 37/02* (2013.01); *H05B 37/0245* (2013.01)

(58) Field of Classification Search
CPC ..... H05B 37/02; H05B 37/0272
USPC ..... 315/297, 320, 312; 710/9, 107; 700/20, 700/11, 275
See application file for complete search history.

(56) References Cited

U.S. PATENT DOCUMENTS

| | | | | |
|---|---|---|---|---|
| 5,352,957 | A | 10/1994 | Werner | |
| 7,161,556 | B2 | 1/2007 | Morgan et al. | |
| 2002/0188781 | A1* | 12/2002 | Schoch | G06F 13/37 710/107 |
| 2004/0232856 | A1 | 11/2004 | Huber | |
| 2006/0193133 | A1 | 8/2006 | Von Der Brelie | |
| 2007/0174885 | A1* | 7/2007 | Hus | H04L 1/1607 725/105 |
| 2007/0260764 | A1 | 11/2007 | Summers et al. | |
| 2009/0021955 | A1* | 1/2009 | Kuang | B60Q 3/0259 362/479 |
| 2010/0079091 | A1* | 4/2010 | Deixler | H05B 37/0254 315/320 |
| 2010/0277079 | A1 | 11/2010 | Van Der Veen et al. | |

FOREIGN PATENT DOCUMENTS

| | | | |
|---|---|---|---|
| CN | 1677945 | A | 10/2005 |
| GB | 2467196 | A | 7/2010 |
| JP | 2009503778 | A | 1/2009 |
| WO | 2008068728 | A1 | 6/2008 |
| WO | 2009090601 | A1 | 7/2009 |
| WO | 2009133489 | A1 | 11/2009 |
| WO | 2010057241 | A1 | 3/2010 |
| WO | 2010066678 | A1 | 6/2010 |

* cited by examiner

*Primary Examiner* — Lincoln Donovan
*Assistant Examiner* — Thomas Skibinski
(74) *Attorney, Agent, or Firm* — Meenakshy Chakravorty

(57) ABSTRACT

In a lighting device (101), a primary control unit (103) is arranged to select, on the basis of an obtained lighting device control command, a broadcast communication mode or an addressing communication mode of a control unit interface (113), and to communicate at least one light generation control command to at least one light unit interface (117) of at least one respective light unit (107) of a group of light units (107) of the lighting device (101) via a control unit interface (113) of the primary control unit (103) using the selected communication mode.

15 Claims, 2 Drawing Sheets

LIGHTING DEVICE

FIELD OF THE INVENTION

The invention relates to the field of lighting devices and controlling light units of a lighting device. More specifically, the invention relates to a lighting device comprising a group of light units, and to a method of controlling light units of a lighting device.

BACKGROUND OF THE INVENTION

WO2008/068728 A1 describes a light source having a plurality of light elements and a plurality of light element controllers, each connected to a respective light element. The light source comprises a bus interface, which is connected via a light source bus to several light element controllers. The light source bus is set in a broadcasting mode. The bus interface broadcasts a general command, typically including overall light settings for the light elements, to the light element controllers. Each light element controller has a capability of calculating specific drive signal data for the light element to which it is connected.

SUMMARY OF THE INVENTION

It is an object of the invention to provide a lighting device wherein communication between different units of the lighting device within the lighting device is simplified.

This object is achieved by a lighting device, comprising:

a primary control unit arranged to obtain a lighting device control command, and comprising a control unit interface; and a group of light units, each light unit of said group being arranged for receiving light generation control commands via a light unit interface of the light unit, wherein the primary control unit is arranged to select, on the basis of an obtained lighting device control command, a broadcast communication mode or an addressing communication mode of the control unit interface, and to communicate at least one light generation control command to at least one of said light unit interfaces of at least one respective light unit of said group of light units via the control unit interface using the selected communication mode.

For example, said lighting device is a luminaire, a light source, or a fixture.

In the following, the term lighting device unit is used to include a light unit as well as said primary control unit and an optional secondary control unit.

By selecting, on the basis of the obtained lighting device control command, a broadcast communication mode or an addressing communication mode, the efficiency of communication within the lighting device (intra lighting device communication) is higher than in a configuration, in which only a broadcasting mode is used, as well as in a configuration, in which only an addressing mode is used. A broadcasting mode is more efficient in most cases compared with an addressing mode, but, depending on the functions provided by the lighting device, there may be situations in which the addressing mode is more efficient.

For example, the primary control unit may comprise a lighting device interface arranged for receiving said lighting device control command. Thus, for example, the primary control unit may comprise a lighting device interface as well as said control unit interface.

In an addressing communication mode, also termed an addressing mode or an individually addressing communication mode, a communication message provided by the primary control unit may comprise an address identification specific to one of the light units. For example, the address identifications may be unique within an individual lighting device, i.e. amongst the light units, the primary control unit and, optionally, further control units of the lighting device. For example, address identifications may be used in an addressing mode only, but not in a broadcast mode.

A light generation control command specifies an action to be taken by the light unit(s) to which the command is directed, which action is related to an attribute of light generation, such as light on/off, light intensity, hue, etc..

For example, each light unit of said group of light units may comprise at least one light element and at least one light element controller connected to the at least one light element and arranged to generate light element drive signals on the basis of a light generation control command received via the light unit interface of the light unit. It should be noted that the term "light element" is understood to include a single light emitter, which is the typical situation, as well as a group of light emitters, which are driven simultaneously, i.e. by the same drive signal. For example, the light element controller is arranged to calculate a drive signal for the at least one light element and to feed the drive signal to the at least one light element, and more particularly to at least one light element driver thereof.

For example, the control unit interface is a bus interface, and the light unit interfaces are bus interfaces. For example, the bus interfaces are serial bus interfaces. For example, the light unit interfaces are connected to the control unit interface. For example, the light unit interfaces are connected to the control unit interface via a lighting device bus. For example, said lighting device bus may be a serial bus. By providing an increased efficiency of the communication within the lighting device, the frequency requirements of the bus interface can be considerably reduced. Consequently, the frequency requirements of the light unit interfaces may be reduced.

For example, the primary control unit is arranged to output, in case the selected communication mode is a broadcast communication mode, said at least one light generation control command at the control unit interface, and to output, in case the selected communication mode is an addressing communication mode, at least one address identification specific to one of the light units and said at least one light generation control command at the control unit interface. Thus, a specific address identification in only output in an addressing communication mode, but not in a broadcast communication mode. For example, in a broadcast communication mode, a broadcast identifier, e.g. in the form specifying an address "0", may be output instead of a specific address identification. For example, the control unit interface and the light unit interfaces are bit serial interfaces.

For example, said specific address identification may be a light unit address identification or a light unit interface address identification.

For example, the primary control unit is arranged to selectively communicate, in case the selected communication mode is an addressing communication mode, at least one light generation control command to at least one of said light unit interfaces of at least one respective light unit of said group of light units via the control unit interface using the selected communication mode and using at least one light unit address identification.

For example, said light unit interfaces are arranged to receive light generation control commands in a broadcast communication mode and in an addressing communication mode.

For example, the primary control unit may comprise a translator for receiving a lighting device control command requiring light generation control of at least two light units of the lighting device, i.e. requiring control of light generation of said at least two light units of the lighting device, and for translating the lighting device control command into light generation control commands for each of said at least two light units, wherein the primary control unit is arranged to selectively operate the translator on the basis of said obtained lighting device control command to translate the lighting device control command into light generation control commands for each of said at least two light units.

For example, the primary control unit is arranged to selectively operate the translator on the basis of said obtained lighting device control command and to select an addressing communication mode for communicating said light generation control commands to said at least two light units. For example, said lighting device control command requiring light generation control of at least two light units of the lighting device may be a lighting device control command requiring control of light generation of all light units of the lighting device, or a lighting device control command related to light generation control of only some of the light units of the lighting device. For example, the light units are not required to perform complex operations of coordinated control of light units, because coordination may be performed by the primary control unit. Thus, the processing capabilities of the light units may be reduced. For example, lighting device control commands requiring a complex processing or a coordinated control of more than one light unit may be translated into a simpler light generation control commands which, for example, may be executed by the light units without interaction between the light units. Thus, for example, dynamic light effects may be performed by the lighting device having light units of a simplified structure and reduced complexity. Moreover, communication within the lighting device is efficient, because a broadcast communication mode may be used for other, e.g. simpler lighting device control commands received by the primary control unit.

For example, the primary control unit is arranged to selectively perform, on the basis of said obtained lighting device control command, one of:

operating the translator and communicating said light generation control commands to the respective said at least two light units via the control unit interface using at least one addressing communication mode; and communicating at least one light generation control command to said group of light units via the control unit interface using a broadcast communication mode. For example, in the latter case, the primary control unit may generate at least one light generation control command on the basis of said obtained lighting device control command. For example, the lighting device control command may be relayed to the light units in form of a light generation control command by the primary control unit.

For example, the primary control unit is arranged to communicate said at least one light generation control command to said at least one of said light unit interfaces, wherein said at least one light generation control command is executable by each respective light unit, to the light unit interface of which it is to be communicated, independently of any other light unit of the group of light units. In particular, it may be executable without requiring communication between the light units. In other words, any light generation control command that is communicated by the primary control unit to any light unit of the group of light units in a broadcast communication mode or an addressing communication mode is a light generation control command that is executable, by the respective at least one light unit it is directed to, independently of any other of said group of light units, and, more particularly, executable without requiring communication between light units. When no communication is required between the light units, the structure of the light units and the light unit interfaces may be considerably simplified.

For example, said light unit interface of each of said group of light units is arranged to be operated, at least with the exception of an initialization of the respective light unit, in a slave communication mode only. Thus, the structure of the light unit interface may be considerably simplified, and the communication within the lighting device may be simplified. In a slave communication mode, an interface does not initiate communication, but only receives and/or responds to communication requests or communicated commands.

For example, the control unit interface is arranged to communicate said at least one light generation control command to at least one of said light unit interfaces of at least one respective one of said group of light units via the control unit interface being operated in a master communication mode, and said at least one of said light unit interfaces is arranged to be operated in a slave communication mode during receiving said at least one light generation control command and during execution of said at least one light generation control command by the respective light unit. Thus, the light unit interface may be operated in a slave communication mode only, optionally with the exception of an initialization phase of the lighting device. For example, said initialization comprises an address identification initialization.

For example, said group of light units, and optionally said primary control unit, form a chain of lighting device units, wherein each succeeding unit comprises an initialization input which is connected to a switchable initialization output of a respective preceding unit, and wherein each preceding unit is arranged to output an initialization signal at the initialization output after initializing an address identification of the unit, and wherein each succeeding unit is arranged to initialize an address identification of the unit upon receiving the initialization signal at the initialization input. Said address identification of a light unit is used when communicating a light generation control command to the respective light unit in an addressing communication mode. Thus, the structure of the light units may be simplified, because the chain structure insures that only one light unit is initialized at a time. Thus, address identifications that are unique within the lighting device may be assigned to the light units in a simple manner, e.g. based on address initialization procedures known as such in the art.

For example, each unit of the chain of units is arranged to assign, in case said unit is the first unit in the chain of units, different address identifications to succeeding units, and each unit of the chain of units is arranged to receive, in case said unit is a succeeding unit in the chain of units, an address identification from the first unit in the chain of units.

For example, initializing an address identification of a unit comprises:

assigning, in case the unit is the first unit in the chain of units, an address identification; and receiving, in case the unit is a succeeding unit in the chain of units, an address identification from the first unit in the chain of units.

For example, initializing an address identification of a unit comprises:

assigning, in case the unit is the primary control unit, a predetermined primary control unit address identification.

For example, assigning address identifications to succeeding units comprises communicating said address identifications to said succeeding units. For example, a new address identification is communicated to a succeeding unit using a default address identification for addressing the unit. Thus, in case the first unit is a light unit, the light unit may communicate an address identification to a succeeding unit, wherein the light unit interface of the first unit is operated in a master communication mode during the address initialization stage of the light device.

In an alternative embodiment, the primary control unit is the first unit of the chain of units and is the only unit of the chain of units which is arranged to assign different address identifications to succeeding units. Therefore, each light unit of the chain of units is a succeeding unit and is arranged to receive an address identification from the primary control unit. In this alternative embodiment, the light unit may be operated in a slave communication mode only. Furthermore, for example, said group of light units may form a chain of light units, and the primary control unit may be arranged to assign different address identifications to the light units.

For example, said chain of lighting device units may be a power supply chain of lighting device units, said initialization input being a power input, said initialization output being a power output, and said outputting of an initialization signal being supplying power at the power output, and said receiving the initialization signal being supplied with power at the power input. Thus, the structure of the lighting device units may be simplified, because initialization of each unit may start at power-up of the respective unit. Furthermore, initialization of the lighting device is simplified, because the light units may be initialized one after the other.

For example, the lighting device may optionally further comprise at least one secondary control unit, which comprises a secondary control unit interface for communicating with the primary control unit via the primary control unit interface. The at least one secondary control unit may be part of the above mentioned chain of lighting device units or said power supply chain of lighting device units.

In a further aspect of the invention, there is provided a light system, comprising a plurality of lighting devices as described above, and a system controller, which is arranged for generating lighting device control commands, and communicating said lighting device control commands to primary control units of said lighting devices via a system interface of the system controller and via lighting device interfaces of said lighting devices. For example, the system interface is a bus interface, and the lighting device interfaces are bus interfaces connected to the system interface via a system bus.

In a further aspect of the invention, there is provided a method of controlling light units of a lighting device, comprising:

obtaining a lighting device control command;

selecting, on the basis of the obtained lighting device control command, a broadcast communication mode or an addressing communication mode for communication to at least one light unit of the lighting device; and communicating at least one light generation control command to at least one light unit of the lighting device using the selected communication mode.

BRIEF DESCRIPTION OF THE DRAWINGS

These and other aspects of the invention will be apparent from and elucidated with reference to the embodiments described hereinafter.

In the drawings.

DETAILED DESCRIPTION OF EMBODIMENTS

Figure 1:
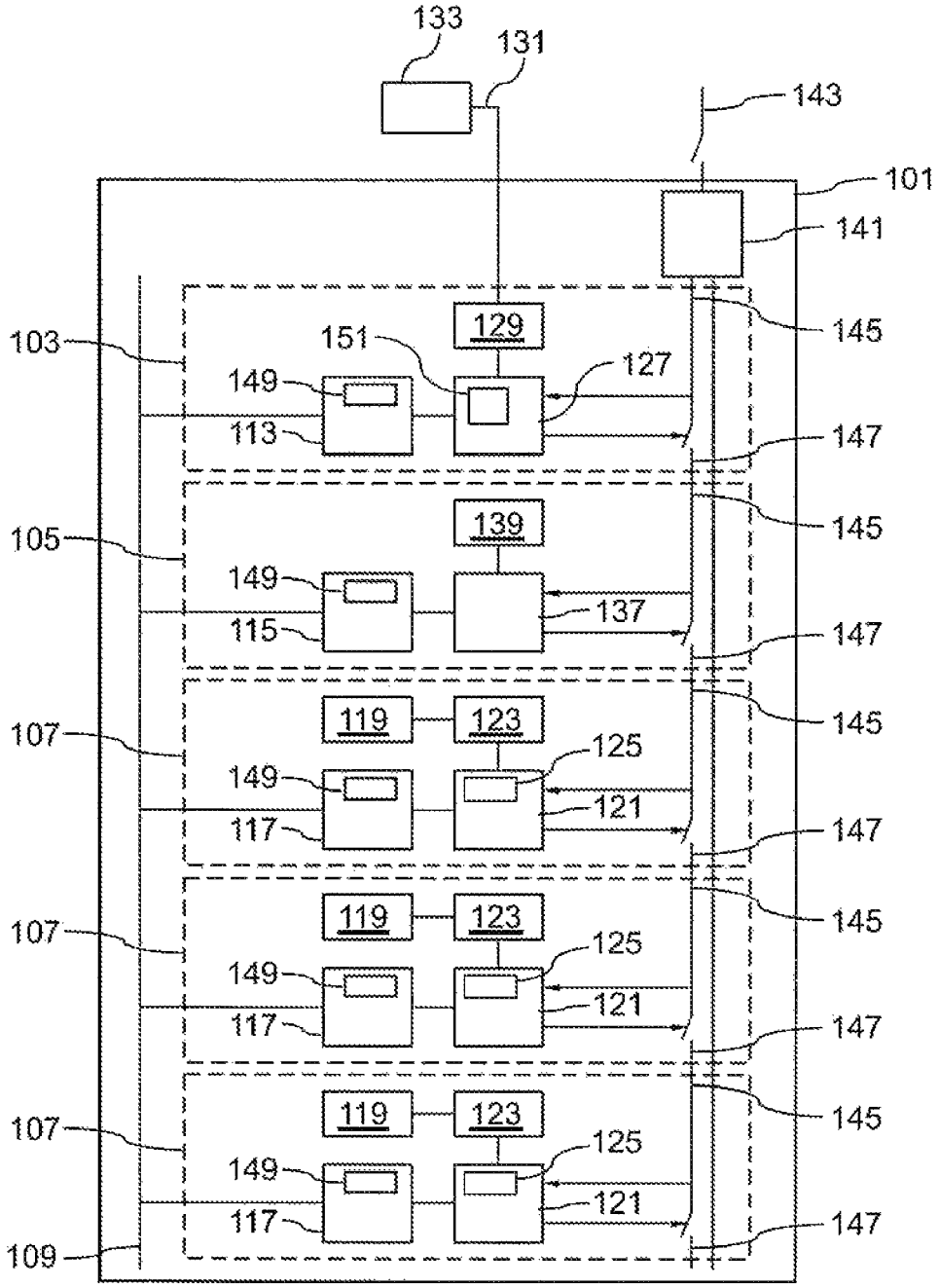
FIG. 1 is a block diagram of an embodiment of a lighting device according to the present invention.

Referring to FIG. 1, an embodiment of a lighting device 101, such as a luminaire, a light source, or a fixture, comprises a primary control unit 103. Further, the lighting device may optionally comprise a secondary control unit 105. Further, the lighting device comprises a group of light units 107. The secondary control unit 105 and the light units 107 are connected via a lighting device bus 109 to the primary control unit 103.

In particular, the primary control unit 103 comprises a control unit interface 113 connected to the lighting device bus 109, the secondary control unit 105 comprises a control unit interface 115 connected to the lighting device bus 109, and the light units 107 each comprise a light unit interface 117 connected to the lighting device bus 109.

Each light unit 107 comprises multiple light elements 119 and a light element controller 121, which is connected to drivers 123 of the light elements 119. In FIG. 1, only one exemplary light element 119 and one exemplary driver 123 is shown per light unit 107. For example, each light unit 107 may comprise light elements 119 of at least three different colors, such as red, green and blue, so that a light unit 107 can generate a large palette of colors. The light element controller 121 is connected to the light unit interface 117. The light element controllers 121 are used for causing the lighting device 101 to emit light of a desired character, for example as regards color and intensity. For example, the light elements 119 are LEDs, but any solid state light (SSL) element is incorporated within the scope of this invention. Additionally, the invention is applicable to conventional lighting devices (TL, HID, etc) and hybrids having controllable light elements. Each light element controller 121 is arranged to obtain light element data. For example, each light element controller 121 has a storage 125, in which light element data, such as peak wave lengths, flux and temperature behavior, for the light element 119 is stored. The light element controller 121 is arranged to generate light element drive signals for the light element driver 123 on the basis of a light generation control command received via the light unit interface 117 and, optionally, on the basis of said light element data.

The primary control unit 103 has a controller 127 that is connected to the control unit interface 113. Further, the controller 127 is connected to a lighting device interface 129, which, in the embodiment of FIG. 1, is a bus interface to be connected to a system bus 131. Via the system bus 131, the lighting device 101 may be connected to a system interface 133 of a light system.

The secondary control unit 105 comprises a controller 137 connected to the control unit interface 115. The controller 137 is further connected to at least one control device 139 of the secondary control unit 105. For example, the control device 139 comprises a sensor. For example, the controllers 127 and 137 are arranged to communicate with each other via the lighting device bus 109.

The lighting device 101 is advantageously modular, the light units 107 being light modules and, preferably, the control units 103 and/or 105 also being control modules. These modules are detachable. Thus, for example, a defective light unit 107 may easily be exchanged.

Power supply of the modules or units is provided via a power supply 141 in the form of a power supply module, which may be connected to mains 143. The control units 103, 105 and light units 107 are arranged in the form of a power supply chain, wherein a power input 145 of the first unit is connected to a power output of the power supply 141, and a power input 145 of a succeeding unit is connected to a switchable power output 147 of the preceding unit. In the embodiment shown, the primary control unit 103 is the first unit, the power input 145 of which being connected to the power supply 141.

On power-up, an initialization is performed as follows. On power-up of each lighting device unit, the respective unit has a default address identification. For example, each light unit 107 and each control unit 103, 105 may have the same default address, and new, individual address identifications are assigned as follows.

The primary control unit 103, being the first lighting device unit in the chain, is supplied with power and initializes a primary control unit address identification, said address identification being stored in a storage 149 of the control unit interface 113. For example, the address identification is a predetermined primary control unit address identification, which may be a fixed address known to all units of the chain.

Then, the unit 103 switches power on its power output 147, and initialization of the succeeding unit, which is the secondary control unit 105 in the described example, is executed as the secondary control unit 105 is powered. For example, the controller 127 of the primary control unit 103 may assign an available, unique address identification to the secondary control unit 105 via the lighting device bus 109 using the default address of the unit 105. The new address identification is stored in the storage 149 of the control unit interface 115. Thus, the unit 105 has received a new address identification.

After initializing the secondary control unit address identification, the controller 137 switches power on at its power output 147. The procedure is repeated in an analogous manner for each light unit 107. Thus, one after the other, the light units 107 are powered, and a unique light unit address identification of each light unit 107 is initialized and stored in the respective storage 149 of the light unit interface 117. After initializing the respective light unit address identification, its controller 121 switches power on at its power output 147.

In this way, address identifications may be assigned to the control units 103, 105, and light units 107, which address identifications are unique within the lighting device 101.

For example, the first unit 103 recognizes when all units connected to the lighting device bus 109 have been initialized, e.g. from receiving no response from the default address. That is, the first unit 103 detects a situation where no unit 105, 107 responds to the default address.

In another example, a control unit 105 or a light unit 107 may be the first unit in the power supply chain. A unit may know that it is the first unit, for example, from detecting that it is not addressed from another unit, i.e. it does not receive communication messages for address initialization. For example, a light unit 107 may be the first unit in the power supply chain. In this case, the address initialization may be performed in an analogous manner, with the light unit 107 assigning unique address identifications to itself and to the control units 103, 105 and the other light units 107 via the lighting device bus 109, using the default address identification for addressing each succeeding unit. However, when the primary control unit 103 is requested to change its address, it will always assign the fixed predetermined primary control unit address identification instead. When the first unit 107 recognizes that all units connected to the lighting device bus 109 have been initialized, it reports to the primary control unit 103, using the known predetermined primary control unit address identification, that the address initialization is completed.

In the described examples, by switching on the power at the power output 147, the respective unit 103, 105 or 107 outputs an initialization signal to the succeeding unit 105 or 107, which is received at the power input 145 of the succeeding unit 105, 107. In other words, switching power on represents an initialization signal for a succeeding unit 105, 107.

In an alternative example, the control units 103, 105 and light units 107 may be arranged in a chain, wherein a dedicated initialization input is connected to a switchable initialization output of a respective preceding unit, each unit being arranged to output an initialization signal at the initialization output, after initializing an address identification of the respective unit 103, 105 or 107. That is, instead of actually switching the power in a power chain, a dedicated initialization signal is output.

Again referring to FIG. 1, for example, the controller 127, the controller 137, and the light element controller 121 also form an address initializer for initializing the address identification of the respective unit 103, 105 or 107. The address initializer is connected to the respective control unit interface 113, 115 or light unit interface 117 and is arranged to perform the address initialization and/or address initialization steps as described above. The light element controller 121 and the controllers 127, 137 are also arranged to switch the respective power output 147 of the respective unit 103, 105 or 107.

Furthermore, during the initialization, a power-up configuration of each unit 103, 105 and 107 will take place. Furthermore, additionally to initializing an address identification, each unit may also initialize a group identification.

The lighting device control operates as follows. For example, via the lighting device interface 129, the primary control unit 103 receives a lighting device control command. For example, the lighting device control command may comprise experience data. Experience data relates to an experience that a user of the lighting device is supposed to experience as a result of the output from the lighting device, such as soft evening light, night darkness, bright working light, etc. Furthermore, the lighting device control command may relate to a dynamic light effect to be performed by the lighting device 101, e.g. a sunrise effect.

The control unit 127 of the primary control unit 103 comprises a translator 151 for receiving such a lighting device control command requiring light generation control of at least two light units 107, and for translating the lighting device control command into light generation control commands for each of said light units 107. The primary control unit 103 is arranged to selectively operate the translator 151, depending on the obtained lighting device control command, to translate the lighting device control command into light generation control commands for at least two of the light units 107 and to select an addressing communication mode for communicating said light generation control commands to the light units 107 via the lighting device bus 109. Thus, complex light effects, such as light effects requiring coordination of two or more light units 107, are translated into a simple light generation control commands for each light unit 107 that participates in performing the effect. Thereby, each light unit 107 receives light generation control commands that may be executed by the individual light unit 107 independently of the other light units 107, since temporal and/or positional coordination can be controlled by the controller 127. Thus, only the primary control unit 103 has the application knowledge required for executing the complex lighting device control commands.

Depending on the obtained lighting device control command, the primary control unit may also operate the translator to translate a lighting device control command into at least one light generation control command for all light units 107 of the group of light units 107 and to select a broadcast communication mode for communicating said at least one light generation control command to the light units 107. This will be done for simple commands that are executable by each of the light units 107 independently of any other of the light units 107.

Furthermore, depending on the received lighting device control command, the primary control unit may relay a received lighting device command as a light generation control command. For example, a lighting device control command, such as a command for switching off all light, maybe communicated to the light units 107 using a broadcast communication mode of the lighting device bus 109.

Furthermore, an individual light unit 107 may be addressable via a lighting device control command, which is relayed by the primary control unit as a light generation control command addressed to one light unit 107 using an addressing communication mode for communicating the light generation control command to the respective light unit 107 via the lighting device bus 109.

In general, by selectively operating the translator 151 depending on the received lighting device control command, complex lighting device control commands may be translated into simpler light generation control commands, each being executable by the respective light unit(s), to which it is directed, independently of any other of the light units 107.

For example, the light unit interfaces 117 of the light units 107 are arranged to be operated in a slave communication mode only, during execution of a light generation control command. Therefore, the structure of the light unit 107 is simplified. This is particularly advantageous in case the light units 107 are detachable light modules. For example, only the control unit interfaces 113, 115 of the primary and secondary control units 103, 105 are arranged to be operated in a master communication mode and/or a slave communication mode, whereas the light unit interfaces 117 of the light units 107 are arranged to be operated only in a slave communication mode.

Thus, the primary control unit 103 is arranged to select, on the basis of a received lighting device control command, a broadcast communication mode or an addressing communication mode of the control unit interface 113, and to communicate at least one light generation control command to at least one of the light unit interfaces 117 of the respective light units 107 via the control unit interface 113 using the selected communication mode. Further, the primary control unit 103 is arranged to selectively operate the translator 151 on the basis of the received lighting device control command to translate the lighting device control command into at least one light generation control command for at least two light units 107 of the lighting device 101 and to select, on the basis of the received lighting device control command, a broadcast communication mode or an addressing communication mode of the control unit interface 113, and to communicate the at least one light generation control command to the respective light unit interfaces 117 of said at least two light units 107 via the control unit interface 113 using the selected communication mode.

Via the lighting device interface 129, the primary control unit 103 may be connected outside the lighting device 101. For example, the primary control unit 103 may be connected to a network of lighting devices 101.

Figure 2:
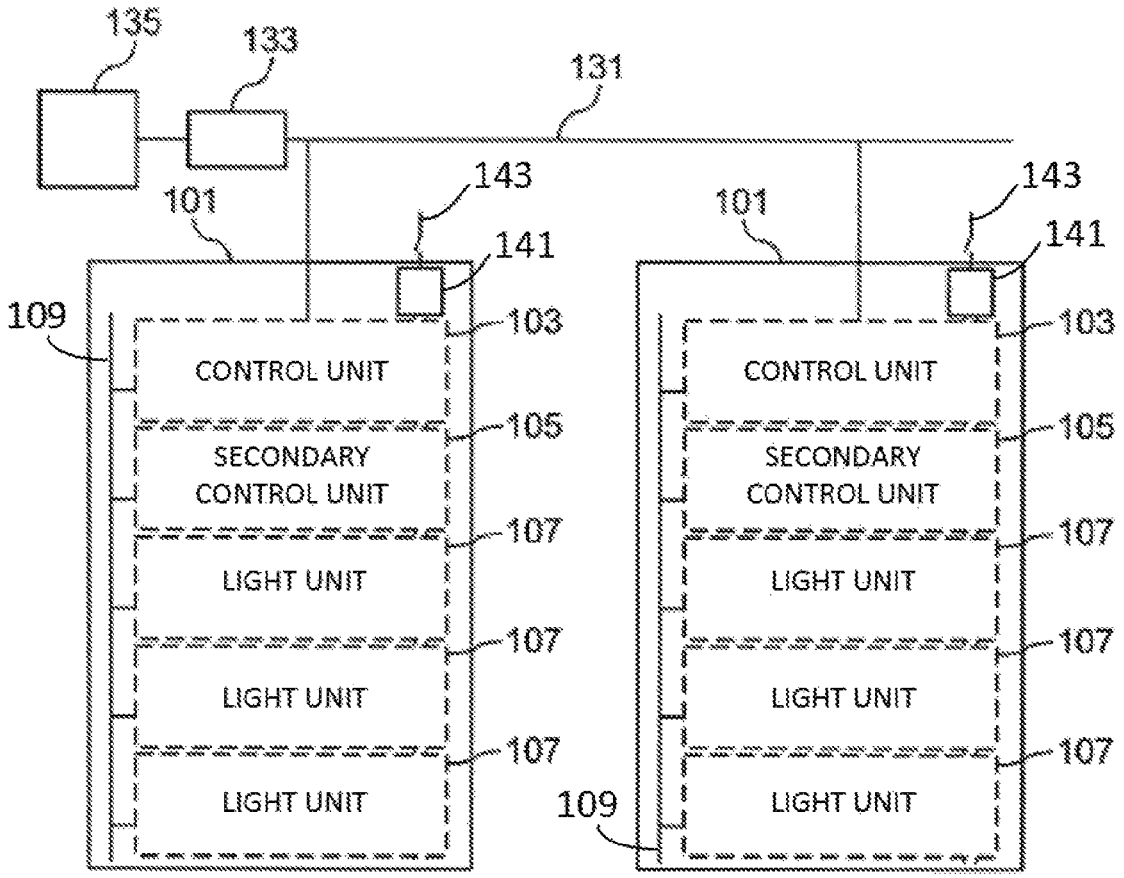
FIG. 2 is a block diagram of an embodiment of a light system according to the present invention.

FIG. 2 shows an example of a light system or luminaire system comprising a plurality of lighting devices 101 and an external system controller 135, which is connected to the lighting devices 101 via a system interface 133 and a system bus 131 as described above. The system controller 135 is arranged for generating lighting device control commands and communicating said lighting device control commands to the primary control units 103 of the lighting devices 101 via the system bus 131.

While the invention has been illustrated and described in detail in the drawings and foregoing description, such illustration and description are to be considered illustrative or exemplary and not restrictive; the invention is not limited to the disclosed embodiments.

For example, the lighting device interface 129 of the primary control unit 103 may comprise a wireless communications interface additionally to or instead of a bus interface. Furthermore, for example, the lighting device interface 129 may comprise a user interface. For example, the primary control unit 103 may receive a lighting control command via the user interface, e.g. generated from a user input. Furthermore, for example, the lighting device interface 129 may comprise a sensor, and, for example, the lighting device interface 129 may be adapted to generate a lighting control command based on a sensor output. Furthermore, for example, the lighting device interface 129 may be implemented in a secondary control unit 105, e.g. in the form of a control device 139, and the primary control unit 103 maybe connected to the lighting device interface 129 via the control unit interfaces 113, 115 and the lighting device bus 109.

Other variations to the disclosed embodiments can be understood and effected by those skilled in the art in practicing the claimed invention, from a study of the drawings, the disclosure, and the appended claims. In the claims, the word "comprising" does not exclude other elements or steps, and the indefinite article "a" or "an" does not exclude a plurality. The mere fact that certain measures are recited in mutually different dependent claims does not indicate that a combination of these measures cannot be used to advantage. Any reference signs in the claims should not be construed as limiting the scope.

The invention claimed is:

1. A lighting device, comprising:

a primary control unit arranged to obtain a lighting device control command and comprising a control unit interface; and a group of light units, each light unit of said group being arranged for receiving light generation control commands via a light unit interface of the light unit, wherein the primary control unit is arranged to select, on the basis of an obtained lighting device control command, a broadcast communication mode or an addressing communication mode of the control unit interface, and to communicate at least one light generation control command to at least one of said light unit interfaces of at least one respective light unit of said group of light units via the control unit interface using the selected communication mode, wherein when the broadcast communication mode is used, the light generation control command comprises a broadcast identifier, and wherein when the addressing communication mode is used, the light generation control command comprises an address identification specific to one of said light units.

2. The lighting device according to claim 1, wherein each light unit of said group of light units comprises at least, one light element and at least one light element controller connected to the at least one light element and arranged to generate light element, drive signals on the basis of a light generation control command received via the light unit interface of the light unit.

3. The lighting device according to claim 1, wherein the control unit interface is a bus interface, and the light unit interfaces are bus interfaces connected to the bus interface of the primary control unit via a lighting device bus.

4. The lighting device according to claim 1, wherein the primary control unit comprises a translator for receiving a lighting device control command requiring light generation control of at least two light units of the lighting device, and for translating the lighting device control command into light generation control commands for each of said at least two light units, wherein the primary control unit is arranged to selectively operate the translator on the basis of said obtained lighting device control command to translate the lighting device control command into light generation control commands for each of said at least two light units.

5. The lighting device according to claim 4, wherein said light generation control commands for each light unit of said at least two light units are executable by each respective light unit of said at least two light units independently of any other of said at least two light units.

6. The lighting device according to claim 1, wherein said light unit interface of each light unit of said group of light units is arranged to be operated in a slave communication mode.

7. The lighting device according to claim 1, wherein said group of light units form a chain of lighting device units, wherein each succeeding unit comprises a initialization input which is connected to a switchable initialization output of a respective preceding unit, and wherein each preceding unit is arranged to output an initialization signal at the initialization output in response to initializing an address identification of the unit, and wherein each succeeding unit is arranged to initialize an address identification of the unit upon receiving the initialization signal at the initialization input.

8. The lighting device according to claim 1, wherein said group of light units form a power supply chain of lighting device units wherein each succeeding unit comprises a power input which is connected to a switchable power output of a respective preceding unit, and wherein each preceding unit is arranged to supply power at the power output in response to initializing an address identification of the unit, and wherein each succeeding unit is arranged to initialize an address identification of the unit upon being supplied with power at the power input.

9. The lighting device according to claim 1, wherein said light units of the group of light units each comprise an address initializer for initializing a light unit address identification, which initializer is connected to the light unit interface and arranged to obtain an address identification of the light unit.

10. The lighting device according to claim 1, said lighting device being one of a luminaire and a light source.

11. A light system, comprising a plurality of lighting devices according to claim 1, and a system interface, which is arranged for communicating lighting device control commands to primary control units of said lighting devices via lighting device interfaces of said lighting devices.

12. A method of controlling light units of a lighting device, comprising;

obtaining a lighting device control command;

selecting, on the basis of the obtained lighting device control command, a broadcast communication mode or an addressing communication mode for communication to at least one light unit of the lighting device; and communicating at least one light generation control command to at least one light unit of the lighting device using the selected communication mode, wherein when the broadcast communication mode is used, the light generation control command comprises a broadcast identifier, and wherein when the addressing communication mode is used, the light generation control command comprises an address identification specific to one of said light units.

13. The method according to claim 12, further comprising:

selectively translating, in case of an obtained lighting device control command requiring light generation control of at least two light units, and depending on the obtained lighting device control command, the obtained lighting device control command into light generation control commands for each of said at least two light units and communicating said light generation control commands to each of said at least two light units using an addressed communication mode.

14. The method according to claim 12, wherein the method is a method of controlling light units of a lighting device, which light units are arranged in a chain of lighting device units, the method further comprising initial steps of:

a preceding lighting device unit initializing a lighting device unit address identification;

the preceding lighting device unit outputting an initialization signal to a succeeding lighting device unit;

the succeeding lighting device unit receiving the initialization signal; and the succeeding lighting device unit initializing a lighting device unit address identification; and steps of outputting, receiving, and initializing being repeated for each succeeding lighting device unit of said chain of lighting device units.

15. The method according to claim 14, wherein, in the outputting step, outputting said initialization signal comprises supplying power to said succeeding lighting device unit, and wherein the step of the succeeding lighting device unit receiving the initialization signal comprises the succeeding lighting device unit being powered.

* * * * *